United States Patent [19]

Gerlach

[11] Patent Number: 4,902,004

[45] Date of Patent: Feb. 20, 1990

[54] EXERCISE HOOP

[76] Inventor: Michael J. Gerlach, 13461 Lake Shore Dr., Herndon, Va. 22071

[21] Appl. No.: 250,172

[22] Filed: Sep. 28, 1988

[51] Int. Cl.[4] ..... A63B 25/08

[52] U.S. Cl. ..... 272/114; 272/DIG. 4

[58] Field of Search ..... 272/114, 70, 70.1, 135, 272/138, 139, 101, 65, 66, 115, 141; 36/7.8; D21/67; 267/158, 160

[56] References Cited

U.S. PATENT DOCUMENTS

| | | | |
|---|---|---|---|
| 406,328 | 7/1889 | Yagn | 272/70 |
| 1,692,482 | 11/1928 | Wilson | 267/158 X |
| 1,984,114 | 12/1934 | Collins | 272/70.1 |
| 2,993,530 | 7/1961 | Little et al. | 272/52 |
| 3,251,145 | 5/1966 | Mack | 36/7.8 |
| 3,958,803 | 5/1976 | Geisselbrecht | 272/135 |
| 4,081,182 | 3/1978 | O'Brien | 272/114 |
| 4,422,627 | 12/1983 | Schmidt et al. | 267/158 X |
| 4,492,374 | 1/1985 | Lekhtman et al. | 272/114 |
| 4,696,467 | 9/1987 | Markow | 272/114 |

OTHER PUBLICATIONS

Publication, The Washington Star—Alley Oop, 2/28/80.

*Primary Examiner*—Richard J. Apley
*Assistant Examiner*—H. Flaxman
*Attorney, Agent, or Firm*—Finnegan, Henderson, Farabow, Garrett and Dunner

[57] ABSTRACT

An exercise device using a fiber reinforced plastic matrix hoop as a resilient member with telescoping rigid members each connected at respective diametrically opposed locations on the hoop. Elongate weight adjusting members having a length greater than the diameter of the hoop are fastened at opposite ends to the diametrically opposed locations for incremently increasing the weight range of the device. In another embodiment fiber reinforced plastic bow springs are used as the resilient members fastened to opposite ends of the telescoping rigid members. The resilient members may or may not be used with the bow springs.

45 Claims, 5 Drawing Sheets

EXERCISE HOOP

BACKGROUND OF THE INVENTION

1. Field of the Invention

The present invention relates to a recreational exercise device; and more particularly to an exercise device of the type where user locomotion is effected by bouncing.

2. Discussion of Related Art

An exercise device of the type known as a pogo stick has been known for many years. Pogo sticks appear to offer fun and enjoyment to users of all ages, as well as provide beneficial exercise. They are relatively safe to use, even for young children. However, they have never gained the widespread popularity, either as recreational or exercise devices, as did the spring type hobby horses for the very young children, or the trampoline for older children and adults. Some of the lack of this widespread popularity can be attributed to the inherent jolting action or skeletal shock that the user suffers just prior to the users weight overcoming the friction and stiffness of the confined coil spring as the base of the pogo stick strikes the ground. The limitations of the confined spring and friction cause the conventional pogo stick to provide a bouncing action similar to the short hops of a rabbit. A good deal of effort is required in order to effect even these short hops, which detracts substantially from the fulfillment associated with being propelled upwardly and forwardly by the spring action.

Another disadvantage that limits pogo-stick popularity is the required utility surface. By its very nature, the conventional pogo-stick must be used on a concrete, asphalt or hardwood surface in order to effect any bouncing action whatsoever. This of course limits the areas of use and makes them quite impracticable for playground or backyard use.

Of course another characteristic of conventional pogo-sticks is their difficulty of manufacture. Except for the very young children, the resistance to shock and needed strength of the various parts inordinately increases the cost of manufacturing. Also, the pogo stick must be sized accurately for each user weight range.

Various proposals have been offered in an attempt to overcome some of the above limitations. For example, in an attempt to overcome some of the deficiencies of coil springs, a pogo stick was proposed having a telescoping piston and cylinder arrangement incorporating an air spring. The air pressure in the cylinder is varied depending on the weight of the user. Also, other types of spring action, such as rubber balls, have been proposed. In an attempt to provide a device that would operate on lawns or other penetrable surfaces, a plurality of radially spaced spring legs were used to support the device. The above devices appear to be satisfactory for the purposes intended; however, in many instances, disadvantages were overcome at the expense of other features. For example, the device having the air spring was relatively complicated and expensive to manufacture. The multi-legged device occupied a relatively large area, and tended to be unstable when more weight was exerted on certain of the spring legs than others. Additionally, the above mentioned examples, with the possible exception of the air spring, must be individually sized for the various weight ranges of the users.

SUMMARY OF THE INVENTION

One of the objects of the present invention is to provide an improved exercise device that overcomes the deficiencies and limitations of a conventional pogo-stick.

Another object of the present invention is to provide an improved exercise device that minimizes skeletal shock and provides a smooth bouncing action more like a kangaroo than a rabbit.

A further object of the present invention is to provide an improved bouncing type exercise device that can be effectively used on utility surfaces other than concrete or the like.

Still another object of the present invention is to provide an improved exercise device of the pogo-stick type that exhibits minimal friction between moving parts.

A still further object of the present invention is to provide an improved exercise device of the pogo-stick type that is simple in construction, relatively easy to manufacture, and reliable and stable in operation.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention as embodied and broadly described herein, the exercise device of the present invention comprises non-metallic annular resilient spring means having a peripheral annulus of a selected diameter, radial thickness, and axially extending width for bouncing a user within a predetermined weight range off the utility surface engaged by the annular member upon the flexing of the annulus in response to a jumping motion of the user. Elongate means having inner and outer end portions at opposite ends of a longitudinal axis thereof; the elongate means being fixedly mounted at the inner end portion thereof to the annulus at a first location and slidably mounted intermediate the inner and outer end portions thereof adjacent a second location diametrically opposed to the first location. The mounting of the elongate means to the diametrically opposed first and second locations maintains substantial symmetry of flexure of the annulus in response to a compressive and recovery force of the annulus in the direction of the longitudinal axis of the elongate means; a user support having a foot supporting surface disposed for supporting the weight of a user at times when the annular member is upright and engaging the utility surface at the first location, said support being mounted to move with the portion of the annulus adjacent the second location and relative to the annulus portion adjacent the first location; and a handle mounted on the elongate means adjacent the outer end portion thereof and having a portion adapted to be grasped by a user standing on the foot supporting surface.

In another aspect, the exercise device of the present invention comprises non- metallic annular resilient spring means having a peripheral annulus of a selected diameter, radial thickness, and axially extending width for bouncing a user within a predetermined weight range off the utility surface engaged by the annular member upon the flexing of the annulus in response to a jumping motion of the user; an elongate member having inner and outer end portions at opposite ends of a longitudinal axis thereof; the elongate means being fixedly mounted to the annulus at a first location; a user support having a foot supporting surface disposed for supporting the weight of a user at times when the annular member is upright and engaging the utility surface at a second location, said support being mounted to move with the portion of the annulus adjacent the first location and relative to the annulus portion adjacent the second location; a handle mounted on the elongate means adjacent the outer end portion thereof and having a portion adapted to be grasped by a user standing on the foot supporting surface; and weight adjusting means removably coupled to the annular spring means adjacent the first and second locations for resisting compression of the annulus for supporting a user having a second weight range greater than the first named weight range.

Preferably, the non-metallic resilient spring means is a continuous annulus of a fiber reinforced plastic matrix.

The accompanying drawings which are incorporated in and constitute a part of this specification illustrate several embodiments of the invention and, together with the description serve to explain the principles of the invention. Also, the invention disclosure document filed in the U.S. Patent and Trademark Office on Jan. 15, 1988 bearing Ser. No. 184,560 is incorporated herein by reference.

DESCRIPTION OF THE PREFERRED EMBODIMENTS

Figure 1:
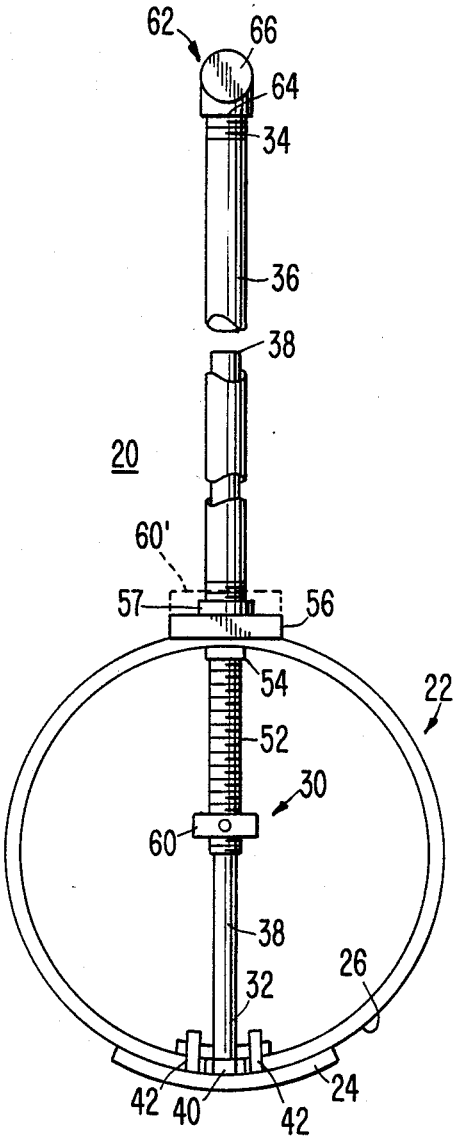
FIG. 1 is a side elevational view of an exercise device in accordance with a first embodiment of the invention.

Reference will now be made in detail to the present preferred embodiments of the invention, examples of which are illustrated in the accompanying drawings wherein like reference numerals refer to like parts throughout the drawings.

Figure 2:
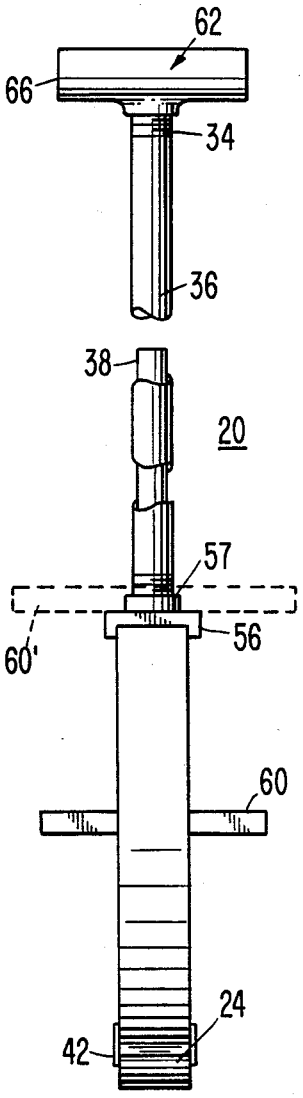
FIG. 2 is a front elevational view of the exercise device of FIG. 1.

Referring to FIGS. 1 and 2, an exercise device for bouncing a user carried by the device from a utility surface according to one embodiment of the invention is generally referred to at 20. In accordance with the invention, the exercise device 20 comprises non-metallic annular resilient spring means having a peripheral annulus of a selected diameter, radial thickness, and axially extending width for bouncing a user within a predetermined weight range off the utility surface engaged by the annular member upon the flexing of the annulus in response to a jumping motion of the user. As embodied herein, a circular non-metallic hoop base 22 constitutes the annular resilient spring means. Hoop 22 may have a rubberized tread strip 24 attached, such as by gluing, for example, to an exterior surface 26 of the hoop to aid in preventing slipping or skidding of the device on a utility surface, such as 26, during use.

Hoop 22 is made of a polymer composite, such as a fiber reinforced plastic matrix of a selected diameter, thickness, and width. The fiber may be composed of fiberglass, aramid, carbon, or graphite; and the plastic matrix may be of the thermosetting type or the thermoplastic type. If composed of the thermosetting type the plastic matrix may be selected from the group including epoxy, polyester, vinylester, phenolic, and polyurethane. If of the thermoplastic type, the matrix may be of the group including ABS, PVC, acrylic, polyamide, polycarbonate, thermoplastic polyester, polyethylene, polystyrene and polysulfone. Preferably, the fiber is fiberglass and the plastic matrix is epoxy or vinylester. To facilitate manufacture, hoop 22 may be made on a mandrel in the same manner as tough fiber reinforced plastic conduit for power and communication lines; and then sliced to the desired widths. In one actual reduction to practice hoop 22 is approximately thirteen inches in diameter, three inches in width, one-eighth of an inch thick, and made of fiberglass and epoxy. Although a device of this size could accommodate a user over a substantially larger weight range, with less satisfying results, satisfactory bounce or rebound may be attained by children in a weight range of from forty to seventy pounds. In another actual reduction to practice, member 22 was approximately eighteen inches in diameter, one-fifth of an inch thick, two inches in width. A child that weighed fifty pounds was able to bounce so that total vertical movement of the child was in the neighborhood of from two and one-half to three feet. A slight forward leaning or "body english" resulted in a forward movement of from two and one-half to four feet. Further, the child was able to effect a three hundred sixty degree spin while the device was out of contact with the utility surface.

In accordance with the invention, elongate means having inner and outer end portions at opposite ends of a longitudinal axis thereof are fixedly mounted at the inner end portion thereof to the annulus at a first location and slidably mounted intermediate the inner and outer end portions thereof adjacent a second location diametrically opposed to the first location.

Figure 3:
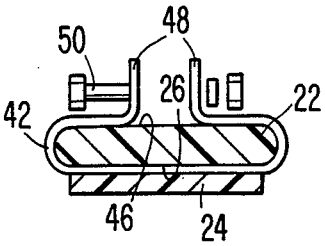
FIG. 3 is an enlarged sectional view of the annulus of the exercise device to illustrate a clamp component used in the present invention.
Figure 4:
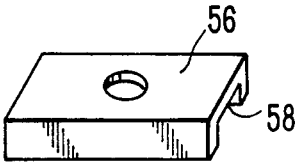
FIG. 4 is an enlarged view of a channel plate that is used in several embodiments of the invention.

As herein embodied, and referring again to FIGS. 1 and 2, the elongate means is an assembly generally referred to as 30 having an inner end portion 32 and an outer end portion 34. Assembly 30 is preferably a first length of thick walled plastic pipe 36 of the type used for piping water under pressure, telescopically mounted to slidably fit over a second length of plastic pipe or rod 38. The outer diameter of pipe 38 and the inner diameter of pipe 36 are dimensioned so that pipe 36 and 38 slide easily relative to one another longitudinally with minimal lateral tolerance. Pipe 38 is securely fastened at inner end portion 32 to a relatively thick rectangular shaped piece of polymer 40, such as nylon, for example. Piece 40, preferably, has a width dimension corresponding to the width dimension of annulus 22, and a length dimension sufficient to accommodate clamps 42 on opposite sides of pipe 38. If rod 38 is solid, polymer piece 40 may be fastened thereto by a screw, for example inserted through the piece and threaded axially into rod 38. If it is hollow, a flanged fitting may be fastened to pipe 38, with the flanges being riveted or screwed to piece 40. Piece 40 is then in turn clamped to inner peripheral surface 46 by clamps 42 on opposite sides of rod 38. Referring to FIG. 3, clamp 42 may be a flexible piece of metal or plastic that has a configuration substantially corresponding to annulus 22 in cross section with integral tabs 48 that are drawn together by a nut and bolt assembly 50. Length of pipe 36 has a machine threaded portion 52 adjacent the end from which rod 38 extends. Pipe 36 extends through a hole drilled or otherwise formed in annulus 22 which is diametrically opposite the location on the annulus where inner end portion 32 of rod 38 is attached. A bushing or sleeve 54 is threadably positioned on threaded portion 52 to longitudinally position pipe 36 relative to rod 38 within the annulus. A channel bar 56 having a channel width corresponding to the width of the annulus may be either threadably or slidably positioned on pipe 36 for fitting engagement with annulus 22 on outer surface 26 thereof. An internally threaded sleeve 57 threaded on pipe 36 in engagement with channel bar 56 tightly secures annulus 22 against surface 58 of the channel of channel bar 56 to complete the installation. The mounting of the elongate means to the diametrically opposed first and second locations maintains substantial symmetry of flexure of the annulus in response to a compressive and recovery force of the annulus in the direction of the longitudinal axis of the elongate means.

The present invention includes a user support having a foot supporting surface disposed for supporting the weight of a user at times when the annular member is upright and engaging the utility surface at the first location, said support being mounted to move with the portion of the annulus adjacent the second location and move relative to the annulus portion adjacent the first location.

As embodied herein and referring again to FIGS. 1 and 2, a foot support 60 for supporting the weight of a user, may be a channel bar similar to channel bar 56 provided it has a length substantially wider than the width of annulus 22. Foot support 60 is threadably fastened to threaded portion 52 of pipe 36 and is preferably adjustable along the length thereof to accommodate the requirements of individual users. Foot support 60 may be either positioned along pipe 36 within the periphery of the annulus, or outside the periphery as shown by foot support 60' in dashed lines of FIGS. 1 and 2. For minimizing the number of different parts in the device, if channel bar 56 slidably fits on pipe 36, foot support 60 or 60' can be secured in position with internally threaded sleeves, for example. Also, for economy of manufacture, channel bar 56 could be configured to have sufficient length and a treaded upper surface to serve as a foot support as well as a support for mounting pipe 36 to annulus 22.

The invention also includes a handle mounted on the elongate means adjacent the outer end portion thereof and having a portion adapted to be grasped by a user standing on the foot supporting surface. As herein embodied, a handle 62 has an internally threaded neck portion 64 which is threaded on outer end 34 of pipe 36. Handle 62 has a portion 64 that extends perpendicular to the axis of assembly 30 which is adapted to be grasped by a user supported on foot support 60.

Figure 5:
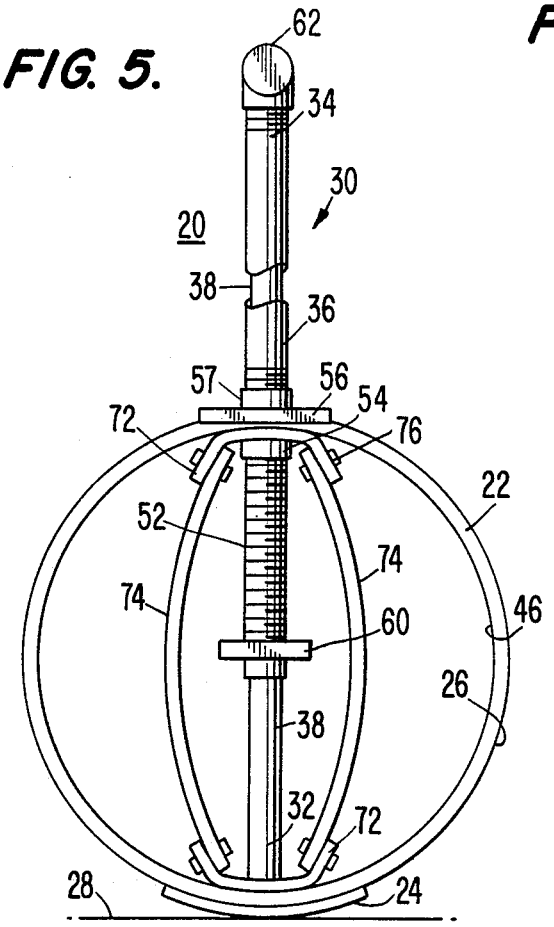
FIG. 5 is a side elevational view of an exercise device in accordance with a second embodiment of the present invention.
Figure 6:
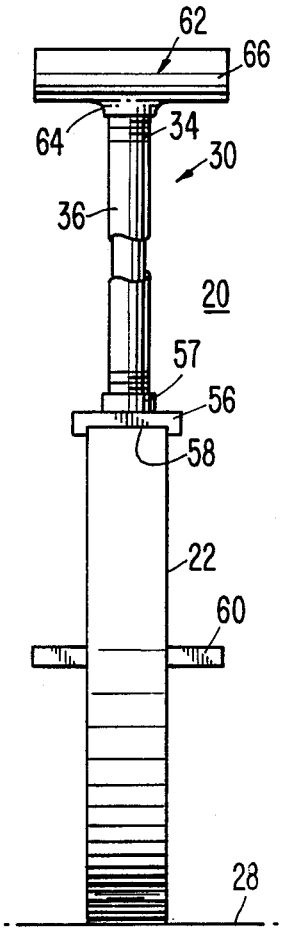
FIG. 6 is a front elevational view of the exercise device of FIG. 5.
Figure 7:
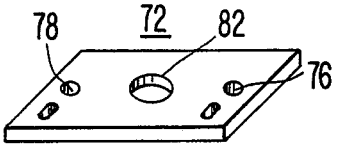
FIG. 7 is an enlarged view of a plastic hinge for removably securing the weight adjusting bars to the device of FIG. 5 and 6.
Figure 8:
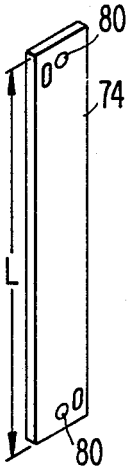
FIG. 8 is a view of the weight adjusting bar of FIG. 5 prior to installation.
Figure 9:
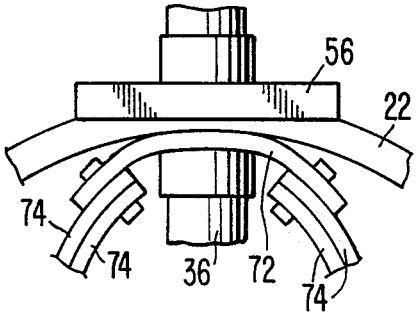
FIG. 9 is an enlarged fragmentary view of the assembly of the weight adjusting bars of FIG. 5.
Figure 15:
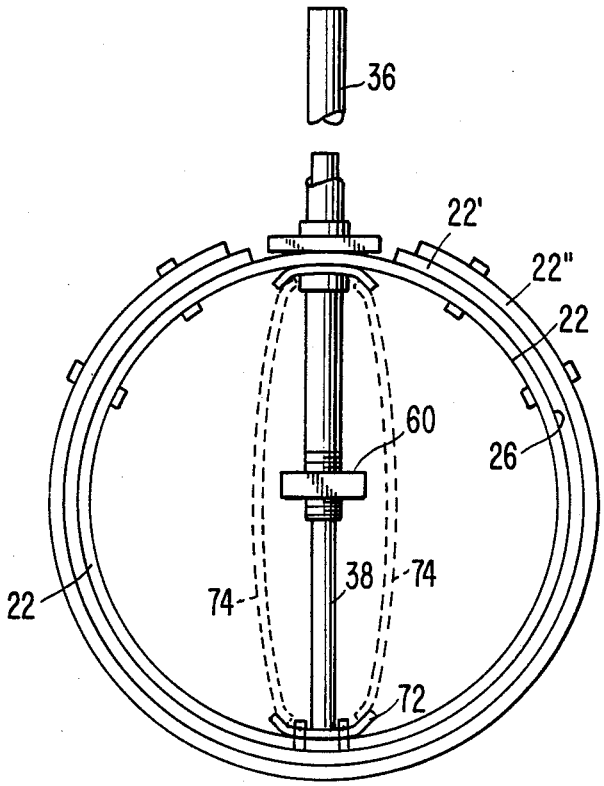
FIG. 15 is an elevational view of a hoop used in the present invention with piggy-backed hoop segments attached to the outer surface thereof.

In accordance with another embodiment of the present invention, the exercise device further comprises weight adjusting means removably coupled to the annular spring means adjacent the first and second locations for resisting compression of the annulus for supporting a user having a second weight range greater than the first named weight range. As embodied herein and referring to FIGS. 5 and 6, exercise device 70 is similar in all respects to exercise device 20 of FIGS. 1 and 2, except that rectangular strips 72, made of a polymer, such as nylon, may either replace, as illustrate,, rectangular piece 40, or if desired, be used in addition thereto at the first location on the annulus. Also, a second rectangular strip 72 is fastened to the annulus at the second location between sleeve 54 and the innersurface 46 of annulus 22. Members 72 are used as supports or hinges for the weight adjusting means, which in the present preferred embodiment constitute elongated resilient members 74 (FIG. 8) having a length L greater than the diameter of annulus 22 with opposite ends thereof mounted to the annulus by attachment to rectangular strips 72. To removably fasten the members 74 in position within the periphery of the annulus, the members are forcibly bowed slightly as illustrated in FIG. 5. Similarly, each of the hinge members 72 are bent inwardly away from inner surface 46 of the periphery of annulus 22, and attached by threaded nuts and bolts 76 extending through holes 76 and 80, respectively. Pipe 36 extends through hole 82 (FIG. 7). Thus, when assembled, the weight adjusting means includes a pair of elongated arcuate resilient members 74, each having opposite ends removably coupled to annulus 22 adjacent the first and second locations diametrically opposite each other, the pair of arcuate members 74 being disposed opposing each other in alignment with the plane of annulus 22. Members 74 are preferably the same width as the width of annular member 22 and have a thickness corresponding to the desired increments of weight range adjustment. As shown in FIG. 9, more than one pair of members 74 can be removably attached to hinge members 72. The weight adjusting members 74 are made of fiber reinforced plastic matrix similar to the annulus 22, and are preferably made in long strips, which are cut to length depending on the diameter of the annulus in which they are to be used. For a device where the elongated weight adjusting members are installed, rod or pipe 38 may be omitted therefrom because members 74 provide additional support that increases the stability and tendency of the annulus to maintain alignment without warping during use. Referring to FIG. 15, and in accordance with the present invention, an arcuate segment such as 22' may be fastened in a piggy-back manner on outer surface 26 of hoop 22 to increase the weight capacity of the device. Also, one or more additional segments, such as 22'' may be piggy-backed on segment 22'. Such segments may be used with or without weight adjuster members 74. In one actual reduction to practice, member 22 was one-fifth of an inch thick, two inches wide and approximately 18 inches in diameter had one segment 22' of the same thickness and width fastened to outer surface 26 of hoop 22 in conjunction with two pair of weight adjuster members as described in connection with FIGS. 5 and 6 of the same thickness and width. This device was able to be used in a very satisfactory manner by an adult weighing 210 pounds.

Figure 10:
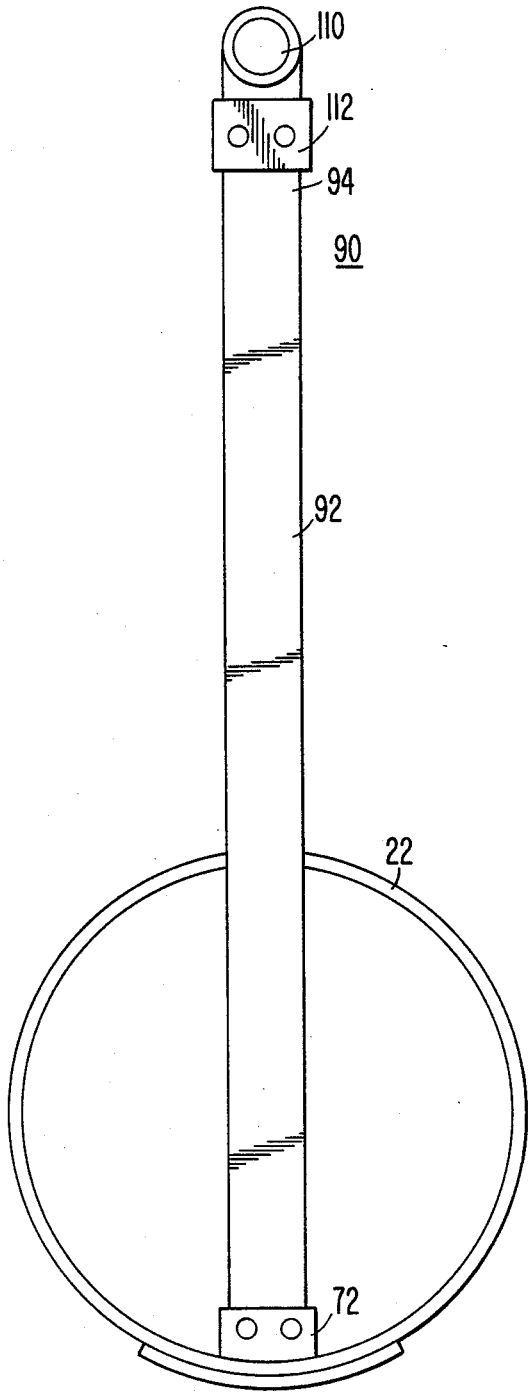
FIG. 10 is a side elevational view of an exercise device in accordance with a third embodiment of the present invention.
Figure 11:
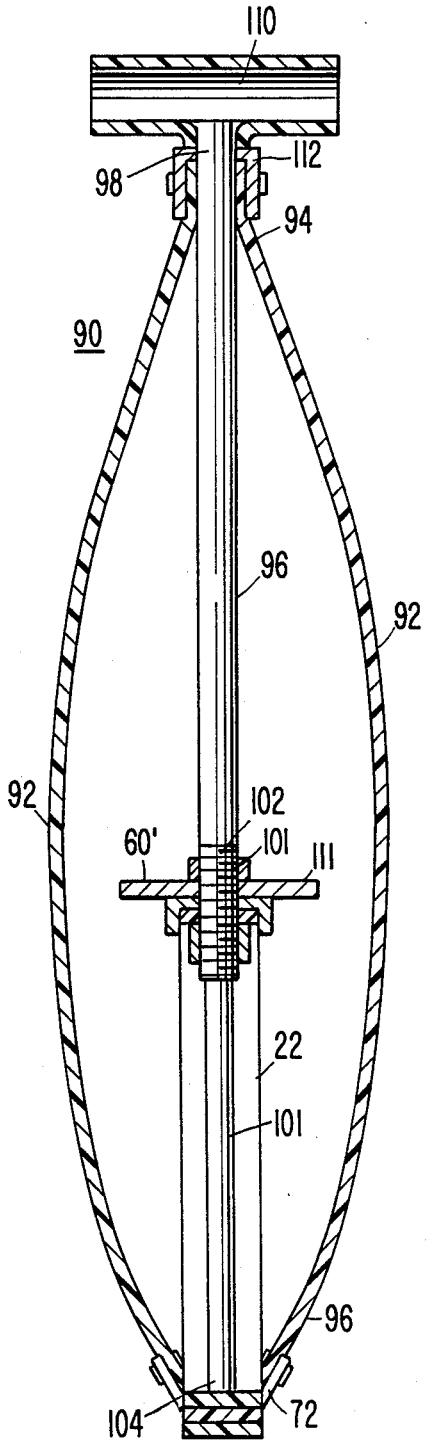
FIG. 11 is a sectional view along line 11—11 of FIG. 10.

In accordance with a third embodiment of the invention, the exercise device, comprises a pair of oppositely disposed resilient arcuate spring segments each terminating at first and second opposite end portions and lying in substantially the same plane. As embodied herein and referring to FIGS. 10 and 11, an exercise device generally referred to as 90 has a pair of arcuate resilient spring segments 92 which terminate at first and second opposite end portions 94 and 96, respectively. Spring segments 92 are preferably made from the same material described in connection with annular member 22 and weight adjuster member 74 discussed in connection with the previously described embodiments. Spring members are preferably approximately three inches wide, one-eighth to one quarter of an inch thick, have a length of anywhere from two to five feet depending on the size of the user.

The invention includes a first substantially rigid elongated member 96 having inner and outer end portions 98 and 100, member 96 is fixedly attached adjacent outer end portion 98 to the first end portion 94 of each spring segment 92 and extends longitudinally along a line substantially corresponding to the common chord of each segment 92. The invention further includes a second substantially rigid elongated member 101 having an inner end portion 102 telescopically mounted to inner end portion 100 of first elongated member 96 for sliding relative the first member longitudinally and having an outer end portion 104 fixedly attached adjacent second end portion 96 of spring segments 92. Relative sliding motion of first and second elongated members 96 and 101 is operative to flex opposing spring segments 92 for storing and releasing energy. A user support 60' is mounted on member 96 intermediate the first and second opposite end portions 94 and 96 of spring segments 92. The support has a foot supporting surface extending in the plane of the oppositely disposed spring, segments for supporting the weight of a user. Foot support 60' (FIG. 11) may be similar to foot support 60' (FIG. 1) previously described. Members 96 and 101 may be similar to members 36 and 38. A handle 110 is mounted on elongated member 96 adjacent outer end portion 98 and has a portion extending substantially parallel to foot support 60' that is adapted to be grasped by a user standing on the foot supporting surface. Exercise device 90 preferably includes annular resilient spring member 22 similar to that discussed in connection with the previous embodiments. As in the previously described embodiments, annulus 22 is coupled to elongate member 96 at a first location 100 and coupled to elongate member 101 at a second location substantially diametrically opposing the first location. Arcuate spring members 92 are assembled adjacent location 104 with nylon hinge 72 in the same manner as described in connection with device 70. Segments 92 are fastened adjacent their ends 94 by the use of a sleeve or adaptor 112 that slips over ends 94 and end 98 of member 96 before handle 110 is threaded on the outer end of member 96.

Figure 12:
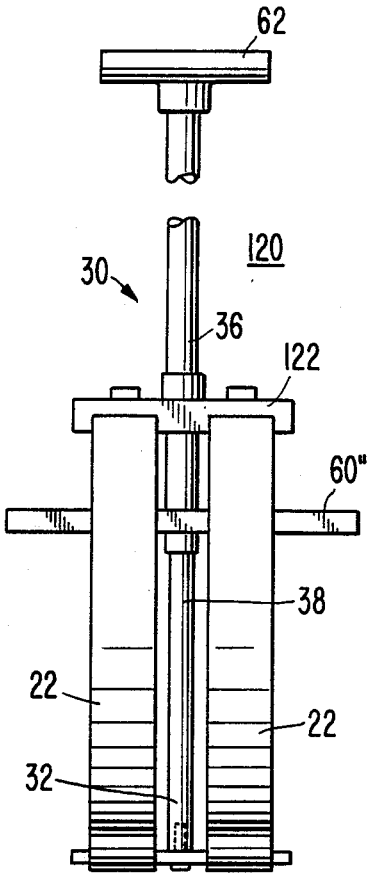
FIG. 12 is a front elevational view of an exercise device in accordance with a fourth embodiment of the present invention.
Figure 13:
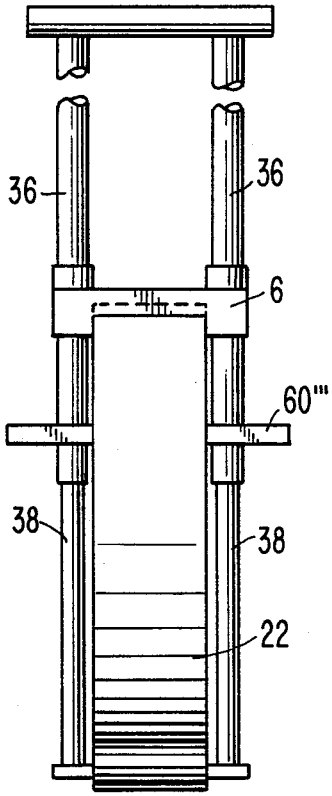
FIG. 13 is a front elevational view of an exercise device in accordance with a fifth embodiment of the present invention.
Figure 14:
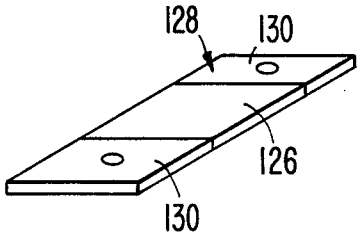
FIG. 14 is a view in perspective of the fastener for the bow springs of FIGS. 10 and 11.

FIGS. 12 and 13 illustrate fourth and fifth embodiments of the present invention of an exercise device for bouncing a user and the device from a utility surface. In accordance with the embodiment of FIG. 12, a device generally referred to as 120, includes a pair of spaced axially aligned annular resilient spring members 22, each having a peripheral annulus of the same predetermined radial thickness and an axially extending width. Fastening means 122 (see FIG. 12) in the form of a bar having spaced channels 124 and 124' engaging first peripheral locations of the spaced spring members 22, and a hard rubber rectangular plate 126 (see FIG. 14) having a length corresponding to the total width dimension of the spaced annular members 22 laminated on a flexible rubber rectangular piece 128 having end flaps 130 that are secured to inner surface 46 of each member 22 for securing the members in axial alignment. A substantially rigid elongated assembly 30 that includes a pipe 36 is coupled to fastening means 122 between the spaced annular spring members 22 adjacent the first location and extends longitudinally along a line corresponding to the diameter of each of the annular spring members, said elongate member 36 has an outer end portion 34 terminating exterior the annulus of each spring member and an inner end portion terminating central of the annulus for supporting a foot support 60'' in the same manner as in the previously described embodiments. The invention may include a second substantially rigid elongated member 38 having an inner end portion telescopically mounted to the inner end portion of elongated member 36 for sliding relative member 36 longitudinally and having an outer end 32 portion fixedly attached to the fastening means adjacent the second location for maintaining substantial symmetry of flexure of each annulus upon relative sliding motion of the elongated members in response to a compressive and recovery force adjacent the first location of the annular members 22. A handle 62 having a grasping portion 66 is fastened to member 36 as previously described.

Referring to FIG. 13, exercise device 140, is similar to the previously described embodiments, except that it has a pair of telescopically connected assemblies straddling opposite sides of annular member 22', which may have a greater width than annular members 22.

In operation, the devices are positioned upright as viewed in the drawings, and the user stands on the foot support and grasps the handle. With the handle securely grasped the user jumps slightly in the air to increase the downward force on the supports. This deforms annulus 22 or segments 92, and weight adjusters 74, if so equipped. Annulus 22 assumes an oval shape as the users body descends at the bottom of the users descent. The resiliency of the annular member causes it to assume its normal configuration propelling the device and the user off the ground or utility surface. With respect to members 74 and 96, the jumping action causes the radius of the arc to decrease at the depth of descent and to spring back for propelling the user upwardly.

It will be apparent to those skilled in the art that various modifications and variations can be made in the exercise device of the present invention and in the manner in which the various parts are attached and assembled. As an example, the annular member 22, weight adjuster 74, and arcuate segment 92, all may be tubular in cross section. Foot supports 60 may also be tubular. Although, the invention is illustrated as comprising a circular spring member, it is contemplated that it could be elliptical or irregular in configuration. Thus, it is intended that the present invention cover the modifications and variations of this invention provided they come within the scope of the appended claims and their equivalents.

What I claim is:

1. An exercise device for bouncing a user carried by the device from a utility surface, comprising:

a non-metallic annular resilient spring means having a peripheral annulus of a selected diameter, radial thickness, and axially extending width for bouncing a user within a predetermined weight range off the utility surface engaged by the annulus upon the flexing of the annulus in response to a jumping motion of the user;

elongate means having first and second end portions defining a longitudinal axis extending therebetween, the elongate means being fixedly mounted adjacent the first and second end portions thereof to the annulus at respective diametrically opposed first and second locations, the first and second end portions being compressible and expandable toward and away from one another respectively along the defined longitudinal axis, the elongate means maintaining substantial symmetry of flexure of the annulus in response to a compressive and recovery force in the direction of the defined longitudinal axis;

a foot support mounted on either one of said annulus and said elongate means for supporting the weight of a user at times when the annulus is upright and engaging the utility surface at the first location, said support being mounted to move with the annulus adjacent the second location and relative to the annulus adjacent the first location; and a handle means mounted spaced from the foot support for grasping by a user standing on the foot support.

2. The exercise device of claim 1 wherein the annular spring means is circular in configuration in an unflexed state.

3. The exercise device of claim 1, wherein the first end portion includes:

a first substantially rigid elongate member fixedly attached to the annulus at the first location and extending longitudinally along a line corresponding to the diameter of the annulus; and wherein the second end portion includes:

a second substantially rigid elongate member telescopically mounted to the first elongate member for sliding relative the first member longitudinally and fixedly attached to the annulus at the second location.

4. The exercise device of claim 1 wherein the foot support is mounted external to and supported by the annulus at the second location.

5. The exercise device of claim 1 wherein the foot support extends axially for supporting the weight of a user straddling the annulus, said support being fixedly coupled to the elongate means.

6. The exercise device of claim 1 wherein the foot support is mounted to the elongate means interior the annulus.

7. The exercise device of claim 1 wherein the annulus is a fiber reinforced plastic matrix.

8. The exercise device of claim 7 wherein the annulus is circular in configuration when in an unflexed state.

9. The exercise device of claim 7 wherein the fiber is fiberglass and the plastic matrix is epoxy or vinylester.

10. The exercise device of claim 7 wherein the fiber is selected from the group consisting of aramid, carbon, or graphite.

11. The exercise device of claim 7 wherein the plastic matrix is the thermosetting type and is selected from the group consisting of epoxy, polyester, vinylester, phenolic, or polyurethane.

12. The exercise device of claim 7 wherein the plastic matrix is the thermoplastic type and is selected from the group consisting of ABS, PVC, acrylic, polyamide, polycarbonate, thermoplastic polyester, polyethylene, polystyrene, or polysulfone.

13. The exercise device of claim 1 further comprising:

elongate weight adjusting means removably coupled to the annulus for resisting compression of the annulus when supporting a user having a second predetermined weight range greater than the first named predetermined weight range.

14. An exercise device for bouncing a user and the device from a utility surface, comprising:

an annular resilient spring member having a peripheral annulus;

elongate means having first and second linear member portions slidable axially relative to one another, fixedly mounted to the annulus at respective first and second diametrically opposed locations, the second member extending externally to the annulus longitudinally along a line substantially corresponding to an extension of the diameter of the annulus;

a foot support for supporting the weight of a user, said support being fixedly coupled interior the annulus to the second member portion and movable axially relative the first member; and a handle mounted on the elongate second member portion external to the annulus and having a portion extending substantially parallel to the foot support for grasping by a user standing on the foot support;

the annulus of the resilient member having a selected diameter, radial thickness, and width for bouncing a user within a first predetermined weight range off the utility surface upon the flexing of the annulus in response to a jumping motion of the user.

15. The exercise device of claim 14 further comprising weight adjusting means including at least one resilient member having a length less than the circumference of the annulus mounted to the exterior peripheral surface of the annulus.

16. The exercise device of claim 14 further comprising weight adjusting means including at least a pair of elongate arcuate resilient members removably coupled to the annulus adjacent the first and second location respectively, the pair of arcuate members being disposed on opposite sides of the first and second elongate members in alignment with the annulus.

17. The exercise device of claim 14 wherein the annulus is circular in configuration.

18. An exercise device for bouncing a user and the device from a utility surface, comprising:

a pair of oppositely disposed resilient arcuate spring segments each terminating at first and second opposite end portions and lying in substantially the same plane;

a first substantially rigid elongate member having inner and outer end portions, said member being fixedly attached adjacent the outer end portion thereof to the first end portion of each spring segment and extending longitudinally along a line substantially corresponding to the common chord of each segment;

a second substantially rigid elongate member having an inner end portion telescopically mounted to the inner end portion of the first elongate member for sliding relative the first member longitudinally and having an outer end portion fixedly attached adjacent the second end portion of the spring segments, relative sliding motion of the first and second elongated members being operative to flex the opposing spring segments for storing and releasing energy;

a foot support mounted on the first elongate member intermediate the first and second opposite end portions of the spring segments, for supporting the weight of a user; and a handle means mounted to be grasped by a user standing on the foot supporting surface.

19. The exercise device of claim 18 further comprising:

an annular resilient spring member having a peripheral annulus of a predetermined radial thickness and an axially extending width; the annulus being coupled to the first elongate member at a first location and coupled to the second elongate member at a second location substantially diametrically opposing the first location.

20. An exercise device for bouncing a user and the device from a utility surface, comprising:

a pair of spaced axially aligned annular resilient spring members each having a peripheral annulus of a predetermined radial thickness and an axially extending width;

fastening means engaging first and second diametrically opposite peripheral locations of the spaced spring members for securing said members in said axial alignment;

a first substantially rigid elongate member fixedly coupled to the fastening means adjacent the first location and extending longitudinally along a line corresponding to the diameter of each of the annular spring members, said elongate member having an outer end portion terminating exterior the annulus of each spring member and an inner end portion terminating central of the annulus;

a second substantially rigid elongate member having an inner end portion telescopically mounted to the inner end portion of the first elongate member for sliding relative the first member longitudinally and having an outer end portion fixedly attached to the fastening means adjacent the second location for maintaining substantial symmetry of flexure of each annulus upon relative sliding motion of the first and second elongate members in response to a compressive and recovery force adjacent the first location;

a foot support for supporting the weight of a user, said support being fixedly coupled to the first elongate member;

a handle means mounted to be grasped by a user standing on the foot support;

the annulus of each of the spring members having a predetermined thickness and width for bouncing a user within a selected weight range off the utility surface engaged by the annular members adjacent the second location upon the flexing of the annulus in response to a jumping motion of the user.

21. An exercise device for bouncing a user and the device from a utility surface, comprising:

an annular resilient spring member having a peripheral annulus of a predetermined radial thickness and an axially extending width;

a first pair of substantially rigid spaced elongate members fixedly attached to the annulus at a first location and extending longitudinally along a line corresponding to the diameter of the annular member on opposite sides thereof, said members having an outer end portion terminating exterior the annulus and an inner end portion terminating interior the annulus;

a second pair of substantially rigid elongate members having an inner end portion telescopically mounted to the inner end portion of corresponding first elongate members for sliding relative the first members longitudinally and having an outer end portion fixedly attached to the annulus at a second location substantially diametrically opposing the first location for maintaining substantial symmetry of flexure of the annulus upon relative sliding motion of the first and second elongate members in response to a compressive and recovery force adjacent the first location;

a foot support for supporting the weight of a user, said support being fixedly coupled to the first elongate members;

a handle mounted on the first pair of elongate members adjacent the outer end portion thereof to be grasped by a user standing on the foot support;

the annulus of the resilient member having a predetermined thickness and width for bouncing a user within a selected weight range off the utility surface engaged by the annular member adjacent the second location upon the flexing of the annulus in response to a jumping motion of the user.

22. The exercise device of claim 13 wherein the weight adjusting means includes at least one pair of non-metallic resilient members coupled to the annulus and disposed internally and aligned with the annulus on opposite sides of the elongate means.

23. The exercise device of claim 14 further comprising weight adjusting means including at least one elongate resilient member mounted to the annulus adjacent the inner peripheral surface of the annulus.

24. The exercise device of claim 22 wherein the at least one pair of non-metallic members are each coupled to the annulus at opposite ends thereof adjacent the diametrically opposed first and second locations respectively.

25. The exercise device of claim 14 further comprising weight adjusting means including a pair of resilient nonmetallic elongate members fastened at opposite ends to the annulus adjacent the first location and to the second linear member external to the annulus, respectively.

26. The exercise device of claim 14 wherein the annulus is a fiber reinforced plastic matrix.

27. The exercise device of claim 26 wherein the annulus is circular in configuration when in an unflexed state.

28. The exercise device of claim 26 wherein the fiber is fiber glass and the plastic matrix is epoxy or vinylester.

29. The exercise device of claim 26 wherein the plastic matrix is the thermosetting type and is selected from the group consisting of epoxy, polyester, vinylester, phenolic, or polyurethane.

30. The exercise device of claim 26 wherein the plastic matrix is the thermoplastic type and is selected from the group consisting of ABS, PVC, acrylic, polyamide, polycarbonate, thermoplastic polyester, polyethylene, polystyrene, or polysulfone.

31. The exercise device of claim 18 wherein the annulus is a fiber reinforced plastic matrix.

32. The exercise device of claim 31 wherein the annulus is circular in configuration when in an unflexed state.

33. The exercise device of claim 31 wherein the fiber is fiber glass and the plastic matrix is epoxy or vinylester.

34. The exercise device of claim 31 wherein the plastic matrix is the thermosetting type and is selected from the group consisting of epoxy, polyester, vinylester, phenolic, or polyurethane.

35. The exercise device of claim 31 wherein the plastic matrix is the thermoplastic type and is selected from the group consisting of ABS, PVC, acrylic, polyamide, polycarbonate, thermoplastic polyester, polyethylene, polystyrene, or polysulfone.

36. The exercise device of claim 20 wherein the annulus is a fiber reinforced plastic matrix.

37. The exercise device of claim 36 wherein the annulus is circular in configuration when in an unflexed state.

38. The exercise device of claim 36 wherein the fiber is fiber glass and the plastic matrix is epoxy or vinylester.

39. The exercise device of claim 36 wherein the plastic matrix is the thermosetting type and is selected from the group consisting of epoxy, polyester, vinylester, phenolic, or polyurethane.

40. The exercise device of claim 36 wherein the plastic matrix is the thermoplastic type and is selected from the group comprising ABS, PVC, acrylic, polyamide, polycarbonate, thermoplastic polyester, polyethylene, polystyrene, or polysulfone.

41. The exercise device of claim 21 wherein the annulus is a fiber reinforced plastic matrix.

42. The exercise device of claim 41 wherein the annulus is circular in configuration when in an unflexed state.

43. The exercise device of claim 41 wherein the fiber is fiber glass and the plastic matrix is epoxy or vinylester.

44. The exercise device of claim 41 wherein the plastic matrix is the thermosetting type and is selected from the group consisting of epoxy, polyester, vinylester, phenolic, or polyurethane.

45. The exercise device of claim 41 wherein the plastic matrix is the thermoplastic type and is selected from the group comprising ABS, PVC, acrylic, polyamide, polycarbonate, thermoplastic polyester, polyethylene, polystyrene, or polysulfone.

* * * * *